US009330834B2

(12) United States Patent
Morimoto et al.

(10) Patent No.: US 9,330,834 B2
(45) Date of Patent: May 3, 2016

(54) REACTOR

(75) Inventors: Tsutomu Morimoto, Kobe (JP); Kenichi Inoue, Kobe (JP); Koji Inoue, Kobe (JP); Hiroshi Hashimoto, Kobe (JP)

(73) Assignee: Kobe Steel Ltd., Hyogo (JP)

( * ) Notice: Subject to any disclaimer, the term of this patent is extended or adjusted under 35 U.S.C. 154(b) by 0 days.

(21) Appl. No.: 13/698,269

(22) PCT Filed: May 12, 2011

(86) PCT No.: PCT/JP2011/002646

§ 371 (c)(1),
(2), (4) Date: Nov. 15, 2012

(87) PCT Pub. No.: WO2011/145299

PCT Pub. Date: Nov. 24, 2011

(65) Prior Publication Data

US 2013/0063237 A1 Mar. 14, 2013

(30) Foreign Application Priority Data

May 18, 2010 (JP) ..... 2010-113854

(51) Int. Cl.

| | |
|---|---|
| ***H01F 27/28*** | (2006.01) |
| ***H01F 27/02*** | (2006.01) |
| ***H01F 27/24*** | (2006.01) |
| ***H01F 27/30*** | (2006.01) |
| ***H01F 37/00*** | (2006.01) |

(Continued)

(52) U.S. Cl.

CPC ..... *H01F 37/00* (2013.01); *H01F 3/06* (2013.01); *H01F 27/2847* (2013.01); *H01F 3/10* (2013.01)

(58) Field of Classification Search

CPC ..... H01F 27/38; H01F 27/28; H01F 27/306; H01F 3/10; H01F 3/14; H01F 17/04; H01F 37/00; H01F 41/0246; H01F 1/24; H01F 3/06; H01F 27/2847

USPC ..... 336/170, 83, 212, 221, 222, 198, 220

See application file for complete search history.

(56) References Cited

U.S. PATENT DOCUMENTS 2,579,578 A * 12/1951 Horstman et al. ..... 336/215
4,549,130 A * 10/1985 Dobberstein ..... 323/308

(Continued)

FOREIGN PATENT DOCUMENTS

FR 2 438 325 A1 4/1980
JP 55-050606 A 4/1980

(Continued)

OTHER PUBLICATIONS

Office Action from Japanese Patent Office in corresponding Japanese Patent Application No. 2010-113854, dated Sep. 17, 2013, pp. 1-3 in its English translation; pp. 1-3 in Japanese.

(Continued)

*Primary Examiner* — Mangtin Lian
*Assistant Examiner* — Kazi Hossain
(74) *Attorney, Agent, or Firm* — Studebaker & Brackett PC

(57) ABSTRACT

A core member (2) of the disclosed reactor (Da) comprises a magnetic wire material and is arranged outside a plurality of coils (1). As the core member (2) in the reactor (Da) having this structure is a wire material and is arranged outside the plurality of coils (1), the core member (2) can be formed by the winding of the wire material, simplifying manufacturing.

16 Claims, 8 Drawing Sheets

(51) Int. Cl.
*H01F 3/06* (2006.01)
*H01F 3/10* (2006.01)

(56) References Cited

U.S. PATENT DOCUMENTS

| | | | | | |
|---|---|---|---|---|---|
| 4,943,793 | A * | 7/1990 | Ngo et al. | 336/83 | |
| 5,296,830 | A * | 3/1994 | Tamada | H01F 5/02 | 336/192 |
| 5,952,907 | A * | 9/1999 | McWilliams et al. | 336/83 | |
| 6,320,490 | B1 * | 11/2001 | Clayton | H01F 30/10 | 336/170 |
| 7,057,486 | B2 * | 6/2006 | Kiko | 336/178 | |
| 2003/0030529 | A1 * | 2/2003 | Min et al. | 336/182 | |
| 2003/0179062 | A1 * | 9/2003 | Kuwata et al. | 336/83 | |
| 2004/0257188 | A1 * | 12/2004 | Younger et al. | 336/180 | |
| 2005/0104702 | A1 * | 5/2005 | Sano | H01F 17/045 | 336/83 |
| 2007/0018770 | A1 * | 1/2007 | Kamio | 336/221 | |
| 2010/0060999 | A1 * | 3/2010 | Higuchi | G02B 7/08 | 359/814 |
| 2010/0245017 | A1 * | 9/2010 | Hoffmann | H01F 27/323 | 336/222 |
| 2013/0021128 | A1 * | 1/2013 | Yan | H01F 17/045 | 336/83 |

FOREIGN PATENT DOCUMENTS

| | | | |
|---|---|---|---|
| JP | 57-049213 | A | 3/1982 |
| JP | 59-229809 | A | 12/1984 |
| JP | 4-196404 | | 7/1992 |
| JP | 05-039606 | A | 2/1993 |
| JP | 05-039606 | Y | 10/1993 |
| JP | H06-026222 | U | 4/1994 |
| JP | H07-226324 | A | 8/1995 |
| JP | 2003-506855 | A | 2/2003 |
| JP | 2003-522407 | A | 7/2003 |
| JP | 2005-347535 | A | 12/2005 |
| JP | 2006-222244 | | 8/2006 |
| JP | 2009-524255 | * | 6/2009 |
| JP | 2009-524255 | A | 6/2009 |
| WO | WO 00/33331 | A1 | 6/2000 |
| WO | WO 01/57890 | A1 | 8/2001 |
| WO | WO 2007/084963 | A2 | 7/2007 |

OTHER PUBLICATIONS

International Search Report, issued from the International Bureau, in corresponding International Application No. PCT/JP2011/002646, mailed Aug. 16, 2011, pp. 1-2.

Written Opinion from the International Searching Authority in corresponding International Application No. PCT/JP2011/002646 dated Aug. 16, 2011, pp. 1-3.

* cited by examiner (A)

(B)

(A)

(B)

(A)

(B)

REACTOR

TECHNICAL FIELD

The present invention relates to a reactor, which is suitably used in, e.g., an electronic circuit and an electric circuit and, in particular, which is more suitably used in an electric power system.

BACKGROUND ART

A reactor is a passive element using, e.g., windings with intent to introduce reactance in a circuit. The reactor is used in various electronic circuits and electric circuits, etc. for, e.g., preventing harmonic currents in a power-factor improvement circuit, smoothing current pulsations in a current type inverter and chopper control, and boosting a DC voltage in a converter. Further, in the electric power system, the reactor is used as, e.g., a shunt reactor for compensating for a phase-advanced reactive current and boosting a receiving-end voltage, a serial reactor (current limiting reactor) for increasing impedance in the system to reduce the short-circuit capacity, and a arc suppression coil (neutral reactor) for distinguishing a fault current generated in the event of a one-line ground fault.

The reactor includes a coil and an iron core (core member) serving as a path for magnetic flux that is generated when electric power is supplied to the coil. The iron core is fabricated, for example, by layering magnetic steel sheets in the circumferential direction as an integral unit to form a disk-shaped block iron core (also called an iron core packet, a radial block iron core, or a radial core), and by stacking the plurality of disk-shaped block iron cores in the axial direction (see, e.g., Patent Literature (PTL) 1, PTL 2, and PTL 3). More specifically, for example, a cylindrical block iron core is fabricated by successively layering thin iron sheets with different widths to form a sub-block, which has the shape of a sector in section, and by arranging the plurality of sub-blocks in a circular form (see, e.g., PTL 3).

Additionally, the reactor is a device to introduce reactance in a circuit, as described above, and it basically includes one winding per phase. On the other hand, a transformer includes two or more windings per phase and differs from the reactor.

With the related-art reactor, however, because the block iron core is manufactured, as described above, by successively layering thin iron sheets with different widths to form a sub-block, which has the shape of a sector in section, and by arranging the plurality of sub-blocks in a circular form, more man-hours have been required to manufacture the reactor and a cost reduction of the reactor has been difficult to realize.

CITATION LIST

Patent Literature

PTL 1: Japanese Unexamined Patent Application Publication No. 57-049213

PTL 2 Japanese Unexamined Patent Application Publication No. 59-229809

PTL 3: Japanese Unexamined Patent Application Publication No. 2005-347535

SUMMARY OF INVENTION

The present invention has been made in view of the above-described situation, and an object of the present invention is to provide a reactor that can be more easily manufactured.

In the reactor according to the present invention, a core member is formed of a wire made of a magnetic material and is arranged outside a plurality of coils. With the reactor thus constructed, since the core member is formed of the wire and is arranged outside the plurality of coils, the core member can be formed by winding the wire. Hence the reactor can be more easily manufactured.

The above and other objects, features, and advantages of the present invention will be apparent from the following detailed description and the accompanying drawings.

DESCRIPTION OF EMBODIMENTS

An embodiment of the present invention will be described below with reference to the drawings. It is to be noted that components denoted by the same reference symbols throughout the drawings represent the same components, and duplicate description of those components is omitted as appropriate. Further, in this specification, when a component is described as a generic term, it is denoted by a reference symbol without a suffix, and when a component is described as one of individual components, it is denoted by a reference symbol with a suffix.

First Embodiment

Figure 1:
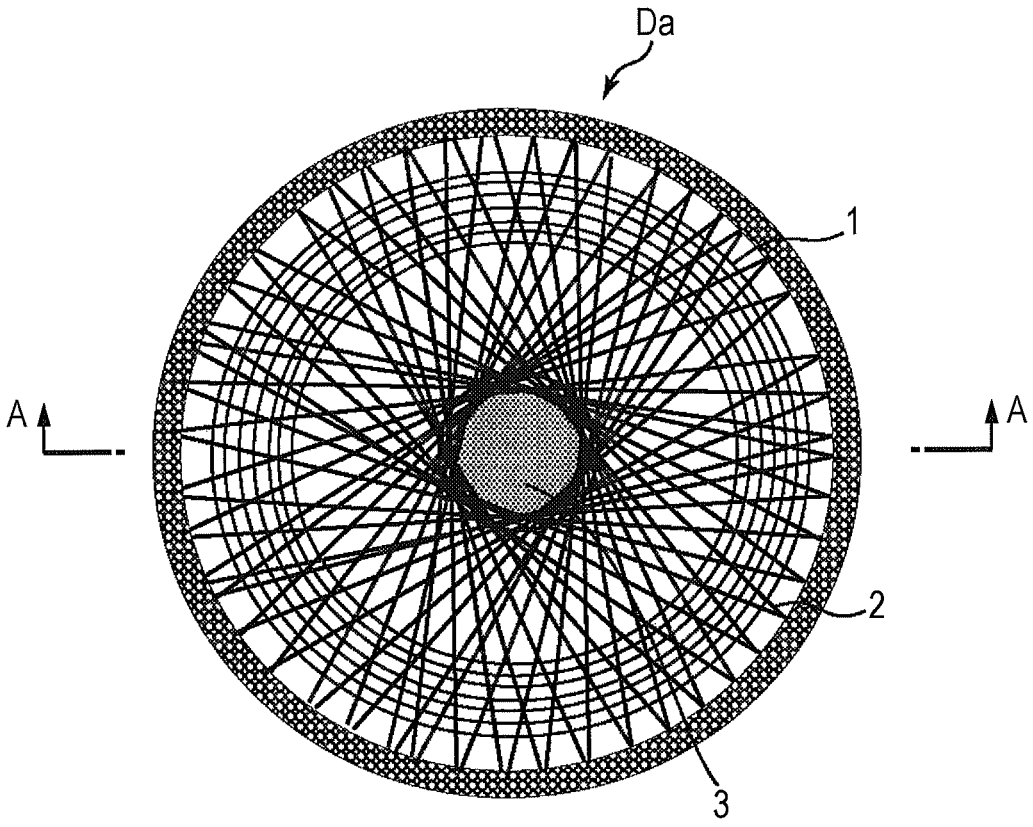
FIG. 1 is a plan view (bottom view) illustrating the structure of a reactor according to a first embodiment.
Figure 2:
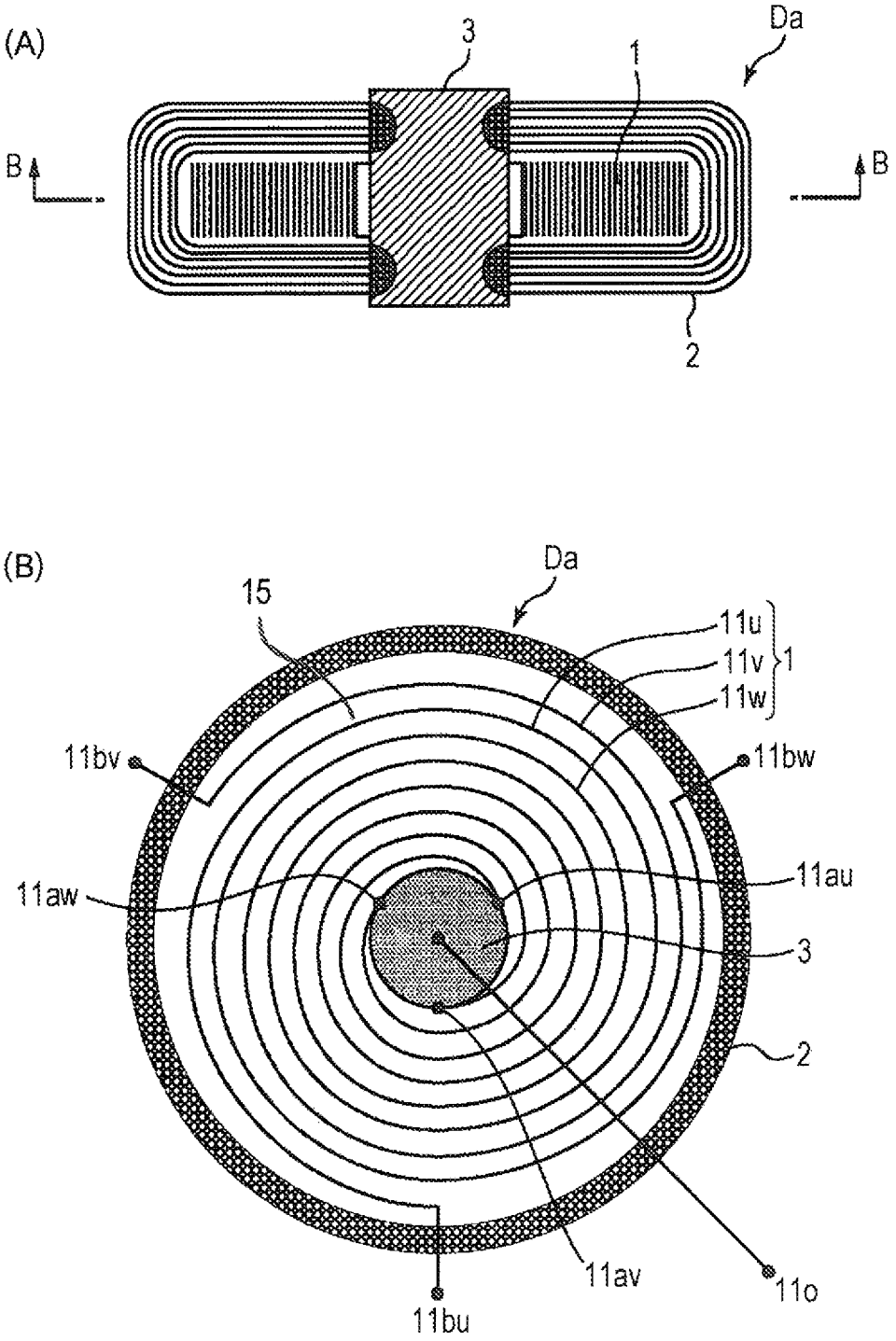
FIG. 2 is a sectional view illustrating the structure of the reactor according to the first embodiment.
Figure 3:
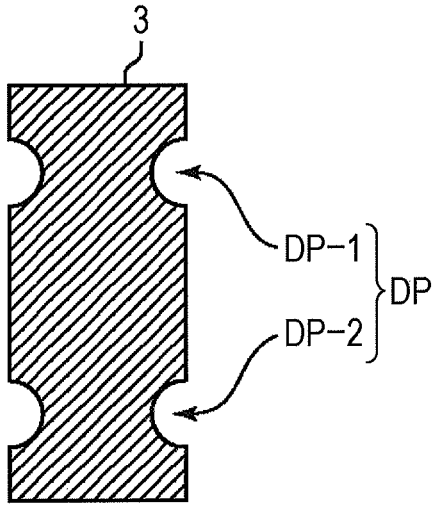
FIG. 3 is an explanatory view to explain a step of preparing a central core member in a method of manufacturing the reactor according to the first embodiment.
Figure 3:
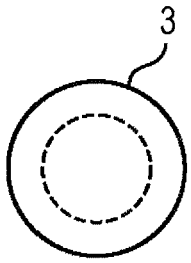
Figure 4:
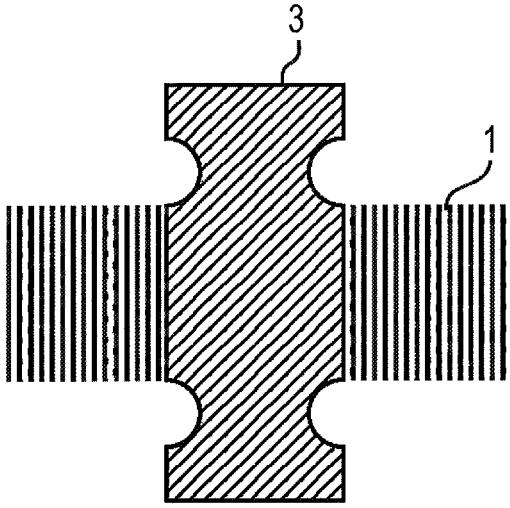
FIG. 4 is an explanatory view to explain a step of forming a plurality of coils in the method of manufacturing the reactor according to the first embodiment.
Figure 4:
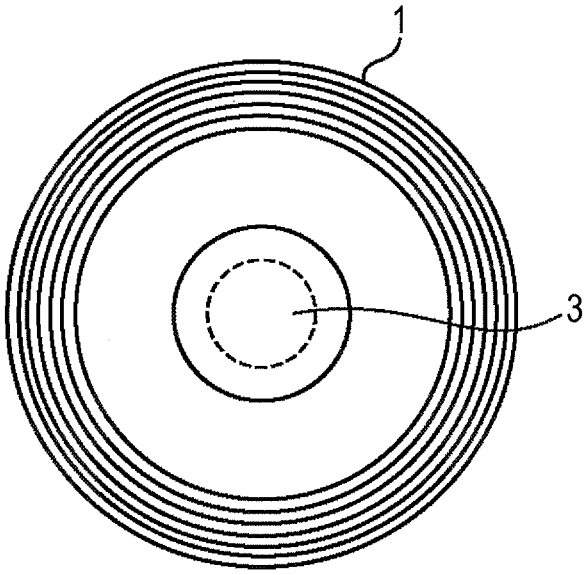
Figure 5:
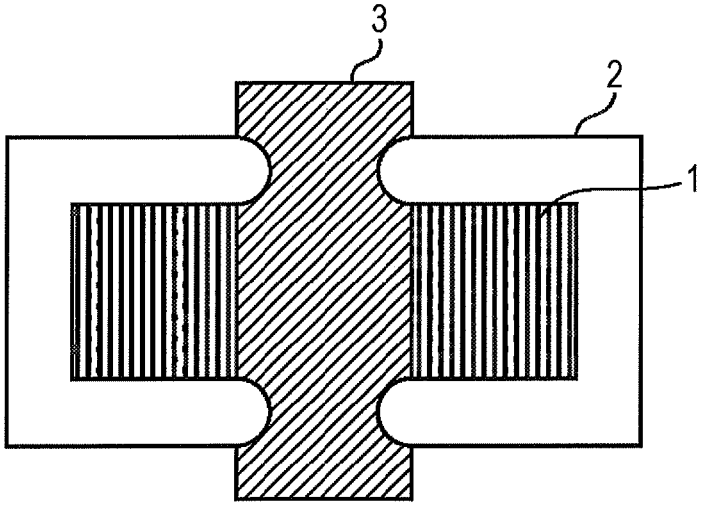
FIG. 5 is an explanatory view to explain a step of forming a core member using a wire in the method of manufacturing the reactor according to the first embodiment.
Figure 5:
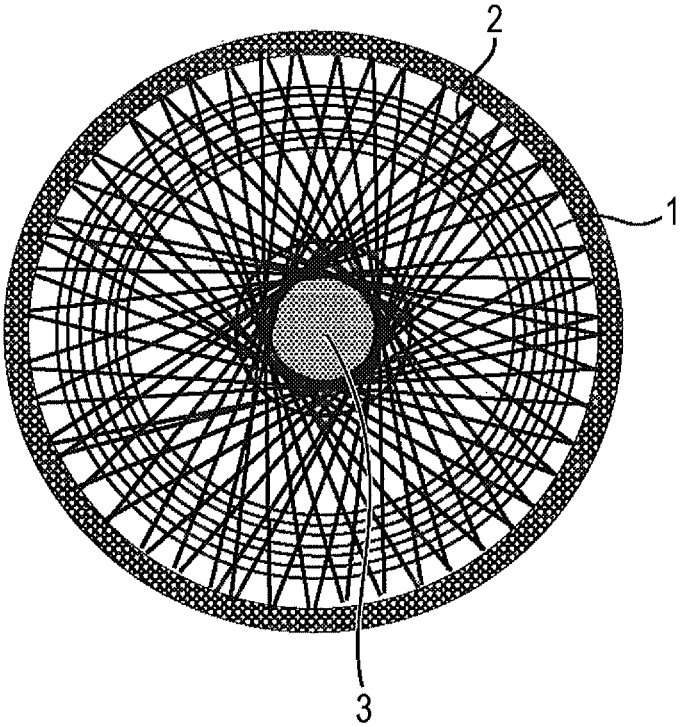
Figure 6:
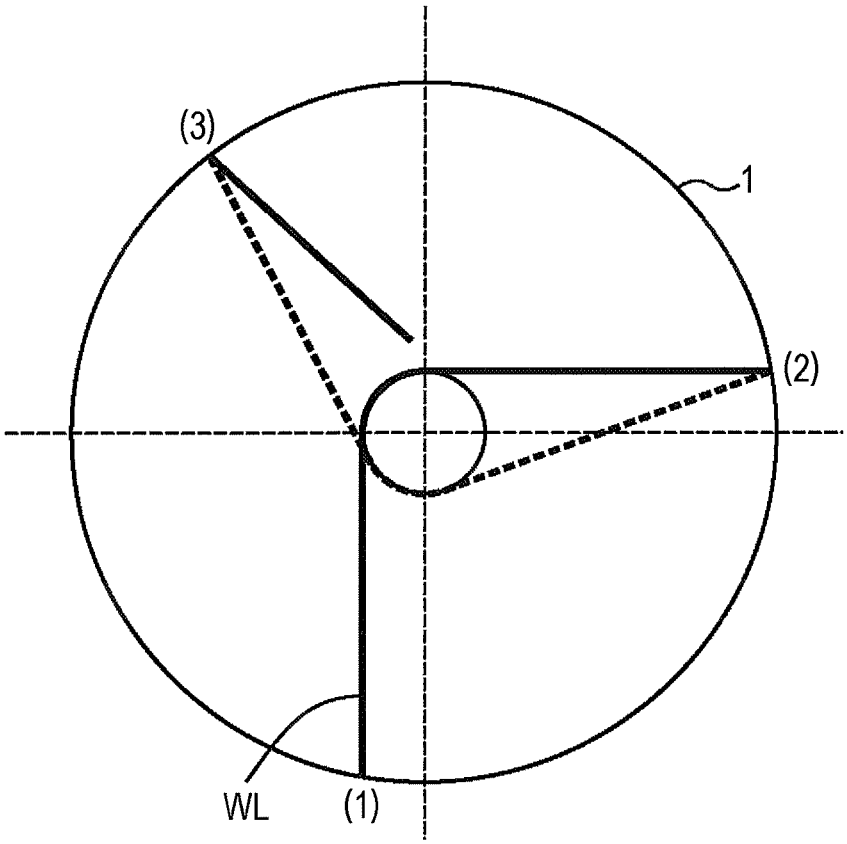
FIG. 6 is an explanatory view to explain a manner of winding the wire in the step, illustrated in FIG. 5, of forming the core member.
Figure 7:
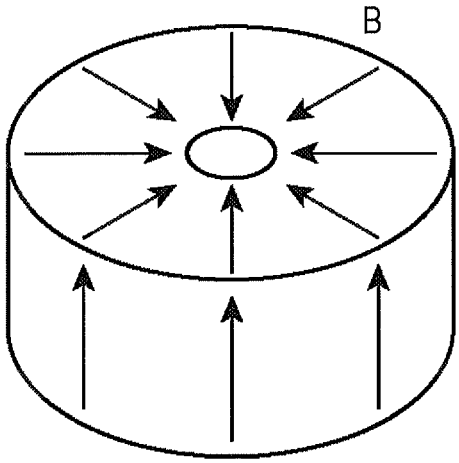
FIG. 7 is an explanatory view to explain the relationship between the lengthwise direction of the wire of the core member and the direction of magnetic flux.

FIG. 1 is a plan view (bottom view) illustrating the structure of a reactor according to a first embodiment. FIG. 2 is a sectional view illustrating the structure of the reactor according to the first embodiment. FIG. 2(A) is a vertical sectional view taken along an AA-line in FIG. 1, and FIG. 2(B) is a horizontal sectional view taken along a BB-line in FIG. 2(A). FIGS. 3 to 6 are explanatory views to explain a method of manufacturing the reactor according to the first embodiment. FIG. 3 illustrates a step of preparing a central core member, FIG. 4 illustrates a step of forming a plurality of coils, and FIG. 5 illustrates a step of forming a core member using a wire. In each of FIGS. 3 to 5, (A) is a vertical sectional view, and (B) is a plan view (bottom view). FIG. 6 is an explanatory view to explain a manner of winding the wire in the step of forming the core member. FIG. 7 is an explanatory view to explain the relationship between the lengthwise direction of the wire of the core member and the direction of magnetic flux.

In FIGS. 1 and 2, a reactor Da of the first embodiment includes a plurality of coils 1, and a core member 2 serving as a path for magnetic flux that is generated when electric power is supplied to the coils 1.

In this embodiment, the coils 1 are constituted, for example, by winding a plurality of long band-like conductor members, which are layered with an insulating member 15 (FIG. 2B) interposed between the conductor members, such that the width direction of the conductor members is matched with the axial direction of the coils 1. Those long band-like conductor members have a sheet shape, a ribbon shape, or a tape shape in which a ratio of the thickness (length in the thickness direction) t to a width (length in the width direction) W is less than 1 ($0<t/W<1$).

The coils 1 may be formed in a desired plural number, e.g., a number determined in design as appropriate depending on use of the reactor Da. For example, the number of plural coils 1 is set as a number corresponding to the number of phases of AC power supplied to the reactor Da. The coils 1 are constituted by, e.g., two band-like conductor members that are layered with an insulating member interposed therebetween, and the reactor Da is used for 2-phase AC power. Alternatively, the coils 1 are constituted by, e.g., three band-like conductor members that are layered with an insulating member interposed therebetween, and the reactor Da is used for 3-phase AC power.

In this embodiment, as illustrated in FIG. 2(B), the coils 1 include three coils 11*u*, 11*v* and 11*w* to be adapted for the 3-phase commercial AC. The first coil 11*u* is used for the U-phase of the 3-phase AC. The other end 11*bu* of the first coil 11*u* is led out as a connection terminal to the outside of the core member 2 and is connected to an electric wire (line) in the U-phase of the 3-phase AC when the reactor is connected to the 3-phase commercial AC. The second coil 11*v* is used for the V-phase of the 3-phase AC. The other end llbv of the second coil 11*v* is led out as a connection terminal to the outside of the core member 2 and is connected to an electric wire (line) in the V-phase of the 3-phase AC when the reactor is connected to the 3-phase commercial AC. The third coil 11*w* is used for the W-phase of the 3-phase AC. The other end 11*bw* of the third coil 11*w* is led out as a connection terminal to the outside of the core member 2 and is connected to an electric wire (line) in the W-phase of the 3-phase AC when the reactor is connected to the 3-phase commercial AC. Further, the first to third coils 11*u*, 11*v* and 11*w* are Y-connected. More specifically, one end 11*au* of the first coil 11*u*, one end 11*av* of the second coil 11*v*, and one end 11*aw* of the third coil 11*w* are connected to one another, and a connection point 11*o* of the three coils is grounded as a neutral point when the reactor is connected to the 3-phase commercial AC. With the coils 1 connected as described above, in this embodiment, the reactor Da for the 3-phase commercial AC is provided, and the 3-phase commercial AC power is supplied to the reactor Da. It is to be noted that, while the first to third coils 11*u*, 11*v* and 11*w* are Y-connected in an example illustrated in FIG. 2(B), they may be Δ-connected.

The core member 2 is a member serving as a path for magnetic flux that is generated when electric power is supplied to the coils 1. The core member 2 is formed using a wire made of a magnetic material and is disposed outside the coils 1. In such an arrangement, the magnetic flux generated when electric power is supplied to the coils 1 circulates in a way starting from one end portion of each coil 1 in the axial direction, passing through the core member 2, and returning to the other end portion of the coil 1 in the axial direction. The magnetic material is, for example, pure iron or an iron-based alloy (such as a Fe—Al alloy, a Fe—Si alloy, sendust, or permalloy), and it is processed into a wire by, e.g., rolling or drawing. While it is preferable that all of the magnetic flux generated when electric power is supplied to the coils 1 passes through the core member 2, the magnetic flux may leak in practice.

In more detail, in the example illustrated in FIGS. 1 and 2, the core member 2 has a structure incorporating the coils 1. Such a structure is formed, for example, by winding the wire of the core member 2 into a shape like a ball (mass) of yarn or string such that the coils 1 are surrounded by the core member 2. The reactor Da of the first embodiment is of the so-called pot type that the coils 1 are entirely surrounded together by the wire of the core member 2.

The core member 2 may have a predetermined sectional shape that is optionally selected. In order to reduce an eddy current loss in each of the conductor members of the coils 1, however, a sectional shape of the core member 2, taken along a plane including an axis of the coils 1, is preferably substantially rectangular as illustrated in FIG. 2(A). In more detail, it is preferable that one inner surface of the core member 2, which is positioned to face respective one end portions of the coils 1 in the axial direction of the coils 1, and the other inner surface of the core member 2, which is positioned to face respective other end portions of the coils 1 in the axial direction of the coils 1, are substantially parallel to each other in regions covering at least the end portions and the other end portions of the coils 1. Although the inner surface of the core member 2 has a corrugated shape because the core member 2 is formed by winding the wire, an averaged surface (average surface) of the corrugated surface may be defined as the inner surface of the core member 2. In an inner space of the core member 2 having such a rectangular shape, since the magnetic flux is formed in a direction almost matched with the axial direction, the respective conductor members of the coils 1 are arranged almost along the direction of the magnetic flux in the inner space. The reactor Da thus constructed can reduce eddy current losses in the conductor members of the coils 1.

Further, the reactor Da of the first embodiment includes, as illustrated in FIGS. 1 and 2, a central core member 3 which is made of a magnetic material, which is arranged within minimum one of inner radii of the coils 1, and which is magnetically coupled to the wire of the core member 2. The central core member 3 has a solid columnar shape having such a length (height) that both end surfaces (top and bottom surfaces) of the central core member 3 are positioned outside the core member 2. A depression DP having a semicircular shape in section is formed in each of circumferential surfaces of both end portions of the central core member 3 in its axial direction to extend round along the circumferential surface.

The central core member 3 has, for example, isotropy and a predetermined magnetic characteristic (permeability) depending on specifications, etc. From the viewpoint of easiness in shaping to the above-described desired shape, the central core member 3 is preferably formed by compacting soft magnetic powder. In the reactor Da thus constructed, the central core member 3 can be easily formed and an iron loss generated in the central core member 3 can also be reduced. More preferably, the central core member 3 is formed by compacting a mixture of soft magnetic powder and non-magnetic powder. A mixing ratio of the soft magnetic powder and the non-magnetic powder can be comparatively easily adjusted, and the predetermined magnetic characteristic in the central core member 3 can be easily realized by appropriately adjusting the mixing ratio.

The soft magnetic powder is ferromagnetic metal powder. More specifically, the soft magnetic powder is, for example, pure iron powder, powder of an iron-based alloy (such as a Fe—Al alloy, a Fe—Si alloy, sendust, or permalloy), amorphous powder, or iron powder having an electrical insulating coating, e.g., a phosphate chemical conversion coating, formed on the surface thereof. The above-mentioned soft magnetic powder can be produced by a known method, such as pulverizing a material with, e.g., atomization, or finely grinding, e.g., iron oxide and reducing the same. Further, it is particularly preferable that the soft magnetic powder is the above-mentioned metal-based material, such as pure iron powder, powder of an iron-based alloy, or amorphous powder, because that metal-based material generally has a larger saturation magnetic flux density when the magnetic permeability is same.

The central core member 3 made of the above-mentioned soft magnetic powder can be formed by a known ordinary process, e.g., powder compacting.

From the viewpoint of downsizing, the central core member 3 is preferably made of a material having higher magnetic permeability than the wire of the core member 2.

The above-described reactor Da can be manufactured, for example, through the following steps. First, as illustrated in FIG. 3, the central core member 3 is prepared which has a solid columnar shape, and which includes the depressions DP (DP-1 and DP-2) formed in respective circumferential surfaces at both the end portions thereof. Further, the band-like conductor member having a predetermined thickness t and coated with an insulating coating is prepared in number corresponding to the number of coils, and those plural conductor members each coated with the insulating coating are successively layered. The following description is made on condition that the number of conductor members is three in order to manufacture the reactor Da illustrated in FIGS. 1 and 2. As a matter of course, each of the following steps can be likewise performed regardless of the number of conductor members. One example of the belt-like conductor member is a copper tape having a thickness t of 0.2 mm and a width of 19 mm and insulated with a Kapton tape. Another conductive metal, such as aluminum, can also be used instead of copper.

Then, respective one ends of the three conductor members layered as description above (i.e., the layered conductor members) are attached to the circumferential surface of the central core member 3 between both the depressions DP-1 and DP-2 and are started to be wound around the above-mentioned circumferential surface in such a state that the width direction of each of the conductor members (i.e., the layered conductor members) is matched with the axial direction of the central core member 3. As illustrated in FIG. 4, the conductor members are wound around the central core member 3 in a predetermined number of turns. As a result, the three coils 1 are formed in a state wound around the central core member 3 with the width direction of each conductor member extending in the axial direction of each coil 1. Thus, the coils 1 are layered substantially in the radial direction. The respective one ends of the layered conductor members are Y-connected, as described above. Alternatively, not-illustrated conductor wires for connection may be led out from the conductor members at the respective one ends of the layered conductor member, and they may be Y-connected in a similar manner to that described above.

Then, as illustrated in FIG. 5, a wire WL of the core member 2 is wound into a ball (mass) of string or yarn while surrounding the coils 1. In more detail, as illustrated in FIG. 6 as one example, the wire WL of the core member 2 is placed on the one surface (upper surface) side of the coils 1 and is pulled to extend from a first predetermined position at an outermost periphery of the coils 1 toward a central portion substantially in the radial direction, as denoted by (1). Near the central portion, the wire WL is engaged in the depression DP-1 of the central core member 3 and is bent at a predetermined angle, e.g., about 90°, to extend from the central portion toward a second predetermined position at the outermost periphery of the coils 1 substantially in the radial direction, as denoted by (2). The wire WL is further pulled to extend along an outermost peripheral surface of the coils 1 to the other surface (lower surface) side. On the other surface (lower surface) side, in a similar manner to that described above for the one surface (lower surface) side, the wire WL of the core member 2 is pulled to extend from another second predetermined position at the outermost periphery of the coils 1 (i.e., from a position on the other surface side corresponding to the second predetermined position on the one surface side) toward the central portion substantially in the radial direction, as denoted by (2). Near the central portion, the wire WL is engaged in the depression DP-2 of the central core member 3 and is bent at a predetermined angle, e.g., about 90°, to extend from the central portion toward a third predetermined position at the outermost periphery of the coils 1 substantially in the radial direction, as denoted by (3). The wire WL is further pulled to extend along the outermost peripheral surface of the coils 1 to the one surface (upper surface) side. Subsequently, the wire WL of the core member 2 is wound so as to entirely cover the outermost peripheral surface of the coils 1 in a similar manner while alternately extending over the one surface side and the other surface side. Preferably, the wire WL of the core member 2 is wound until the coils 1 are concealed by the wire WL of the core member 2 and are not visually noticeable from the outside. Individual turns of the wire W1 may be overlapped with each other. Further, the wire WL of the core member 2 is preferably held in contact with the central core member 3 over a segment of a predetermined length (i.e., line contact), instead of contacting with the central core member 3 at a point (i.e., point contact), such that the wire WL is magnetically coupled to the central core member 3 with higher reliability. The longer the segment of the line contact, the stronger is the magnetic coupling between the wire WL of the core member 2 and the central core member 3. Additionally, at the other ends of the layered conductor members, not-illustrated conductor wires for connection are led out respectively from the conductor members and are further led out to the outside of the core member 2.

Thus, the reactor Da of the so-called pot type is fabricated in a state where the wire WL of the core member 2 is wound into a shape like a ball (mass) of string or yarn while surrounding the coils 1. In the reactor Da thus fabricated, the 3-phase commercial AC power is supplied to the three coils 1.

When the AC power is supplied to the coils 1, magnetic flux B of a magnetic field formed by the coils 1 generates, as denoted by arrows in FIG. 7, in the axial direction of the coils 1 in a region extending in the axial direction thereof and the radial direction of the coils 1 in a region extending in the radial direction thereof. Magnetic resistance of the wire WL of the core member 2 increases at a larger number of times the wire WL traverses the magnetic flux produced by the coils 1 to which the AC power is supplied. In view of that point, the wire WL of the core member 2 is preferably positioned such that the lengthwise direction of the wire WL is matched with the above-described direction of the magnetic flux B as close as possible. When the wire WL of the core member 2 is wound as described above, the predetermined angle at which the wire WL is bent at the central core member 3 is preferably set based on a value of the diameter (outer diameter) of the coils 1, a value of the diameter (outer diameter) of the central core member 3 (specifically, the outer diameter of a portion including the depression DP in the example illustrated in FIGS. 1 and 2), and a value of the diameter of the wire WL, such that the lengthwise direction of the wire WL of the coils 1 is matched with the above-described direction of the magnetic flux B as close as possible. Also in that case, the wire WL is of course preferably held in line contact with the central core member 3 as described above. Thus, in the reactor Da of the first embodiment, by winding the wire WL as described above, the wire WL of the core member 2 is arranged such that the lengthwise direction of the wire WL is almost matched with the direction of the magnetic flux B generated when AC power is supplied to the coils 1. In the reactor Da of this embodiment, therefore, the wire WL of the core member 2 traverses the magnetic flux B at a smaller number of times, whereby the magnetic resistance is reduced. The above expression "almost matched with" implies that the lengthwise direction of the wire WL of the core member 2 is substantially matched with the direction of the magnetic flux B, i.e., that an angle θ formed by the lengthwise direction of the wire WL of the core member 2 and the direction of the magnetic flux B satisfies $-10° \leq \theta \leq +10°$. The angle θ satisfies preferably $-7° \leq \theta \leq +7°$ and more preferably $-5° \leq \theta \leq +5°$.

In the reactor Da of this embodiment, as described above, since the core member 2 is formed of the wire WL and is disposed outside the coils 1, the core member 2 can be formed by winding the wire WL, and the reactor Da can be more easily manufactured. As a result, it is possible to increase productivity and to reduce the cost of the reactor Da of this embodiment.

Although, in the reactor Da of this embodiment, magnetostrictive vibration may occur in the core member 2, the magnetostrictive vibration can be mitigated in the entire core member 2 because the core member 2 is formed of the wire WL and the wire WL is wound in various directions in the whole of the reactor Da.

Since the reactor Da of this embodiment includes the central core member 3, the central core member 3 can be utilized as not only a winding core for the coils 1, but also a winding core for the wire WL of the core member 2. Thus, higher productivity can be obtained.

Further, in the reactor Tra of this embodiment, since the coils 1 are constituted by winding the band-like conductor members that are layered with the insulating member interposed therebetween, the plurality of coils 1 can be formed in one winding step. Accordingly, the reactor Da having the above-described structure can be more easily manufactured.

Here, the three coils 11*u*, 11*v* and 11*w* constituting the plurality of coils 1 may be layered in the radial direction. With such an arrangement, the reactor having a reduced height (thickness) is provided.

Figure 8:
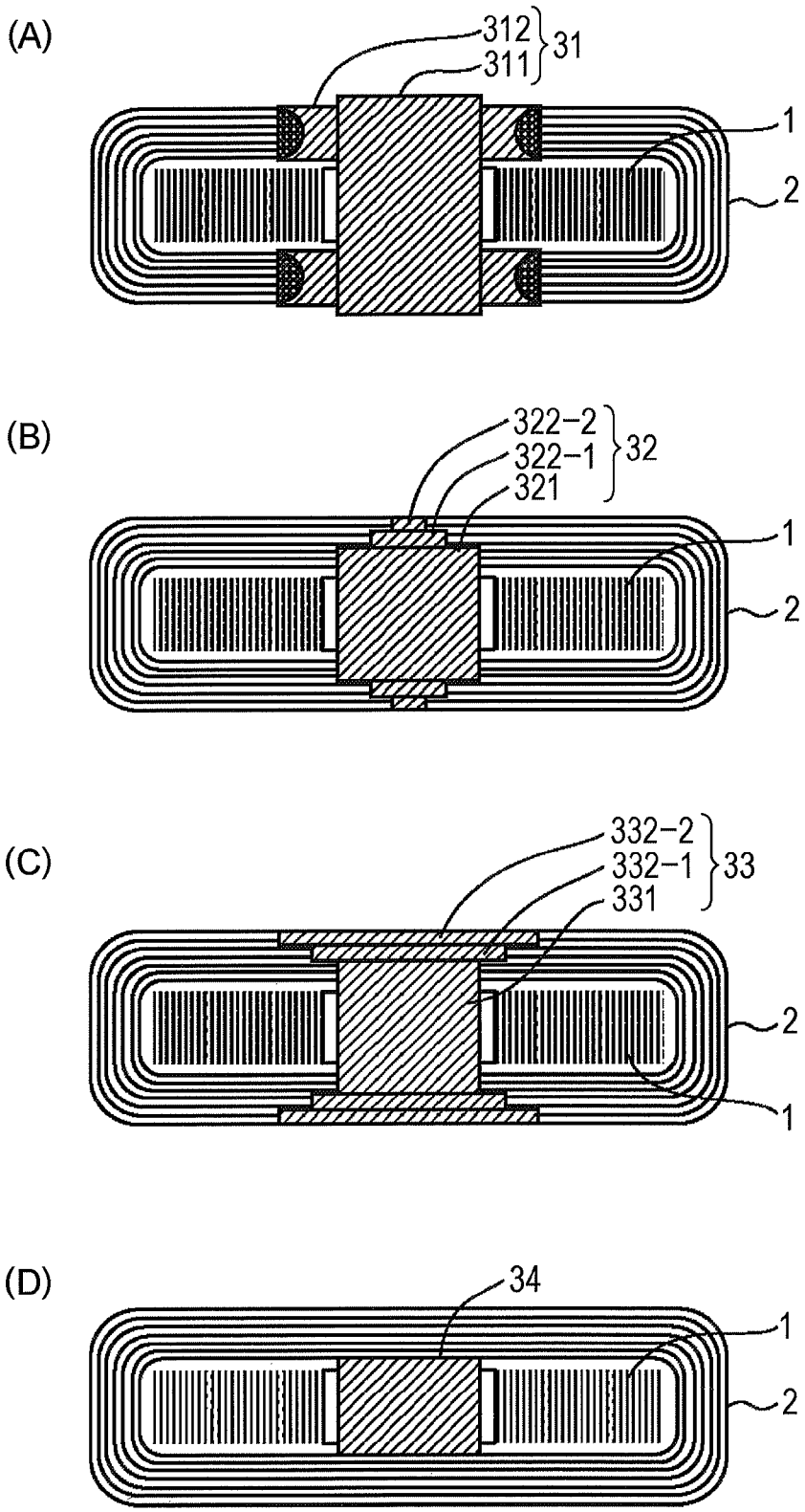
FIG. 8 illustrates modifications of the central core member in the reactor according to the first embodiment.

In the reactor Tra described above, the central core member 3 may have various shapes in addition to the above-described columnar shape including the depressions DP formed in the circumferential surface of both the end portions thereof. FIG. 8 illustrates modifications of the central core member in the reactor according to the first embodiment. FIG. 8(A) illustrates the structure of a first modification, and FIG. 8(B) illustrates the structure of a second modification. FIG. 8(C) illustrates the structure of a third modification, and FIG. 8(D) illustrates the structure of a fourth modification.

As illustrated in FIG. 8(A), a central core member 31 of the first modification includes a solid columnar member 311 and flange members 312 formed at both end portions of the columnar member 311. Each of the flange members 312 is formed in a predetermined thickness and has a depression that is semicircular in section and that is formed in an outermost peripheral surface of the flange member 312 to extend around a circumferential surface thereof. In use of the central core member 31 having the structure described above, the wire WL of the core member 2 is wound while it is engaged in the depressions of the flange members 312.

As illustrated in FIG. 8(B), a central core member 32 of the second modification includes a solid columnar member 321 and at least one first disk-like member 322, which is provided at each of both end surfaces of the columnar member 321 and which has a smaller radius than the columnar member 321. The number of first disk-like members 322 may be optionally selected, and it is two in an example illustrated in FIG. 8(B). Those two first disk-like members 322-1 and 322-2 are layered one above the other and have different diameters such that the diameters gradually reduce toward the outer side of the layered direction (axial direction) (i.e., in a direction farther away from the end surface of the columnar member 321). The first disk-like members 322 may be formed integrally with the columnar member 321. In use of the central core member 32 having the structure described above, the wire WL of the core member 2 is wound while it is engaged with the first disk-like members 322.

As illustrated in FIG. 8(C), a central core member 33 of the third modification includes a solid columnar member 331 and at least one second disk-like member 332, which is provided at each of both end surfaces of the columnar member 331 and which has a larger radius than the columnar member 331. The number of second disk-like members 332 may be optionally selected, and it is two in an example illustrated in FIG. 8(C). Those two second disk-like members 332-1 and 332-2 are layered one above the other and have different diameters such that the diameters gradually increase toward the outer side of the layered direction (axial direction) (i.e., in a direction farther away from the end surface of the columnar member 331). The second disk-like members 332 may be formed integrally with the columnar member 331. In use of the central core member 33 having the structure described above, the wire WL of the core member 2 is wound while it is engaged with the second disk-like members 322.

With the central core members 31 to 33 having the structures described above, since they include respectively the flange members 312, the first disk-like members 322, and the second disk-like members 332, the diameters of the central core members 31 to 33 over which the wire WL of the core member 2 is engaged can be changed. Therefore, the design for setting the lengthwise direction of the wire WL to be almost matched with the direction of the magnetic flux is facilitated.

Further, with the central core member 33, since the diameters of the second disk-like members 332 gradually increase toward the outer side of the layered direction, the wire WL engaged over one second disk-like member 332 on the inner side (e.g., the second disk-like member 332-1) can be retained (held) by the other second disk-like member 332 on the outer side (e.g., the second disk-like member 332-2 in the illustrated example). Accordingly, the shape of the core member 2 can be stably maintained.

As illustrated in FIG. 8(D), a central core member 34 of the fourth modification has a solid columnar form having such a length (height) that both end surfaces (top and bottom surfaces) of the central core member 34 are positioned without reaching the outer side of the core member 2. For example, the height of the central core member 34 is substantially equal to the length of the coils 1 in the width direction thereof.

In use of the central core member 34 having the structure described above, the core member 2 is disposed even on both the end surfaces of the central core member 34. When the wire WL of the core member 2 is closely wound, the coils 1 can be completely surrounded by the core member 2.

Another embodiment will be described below.

Second Embodiment

Figure 9:
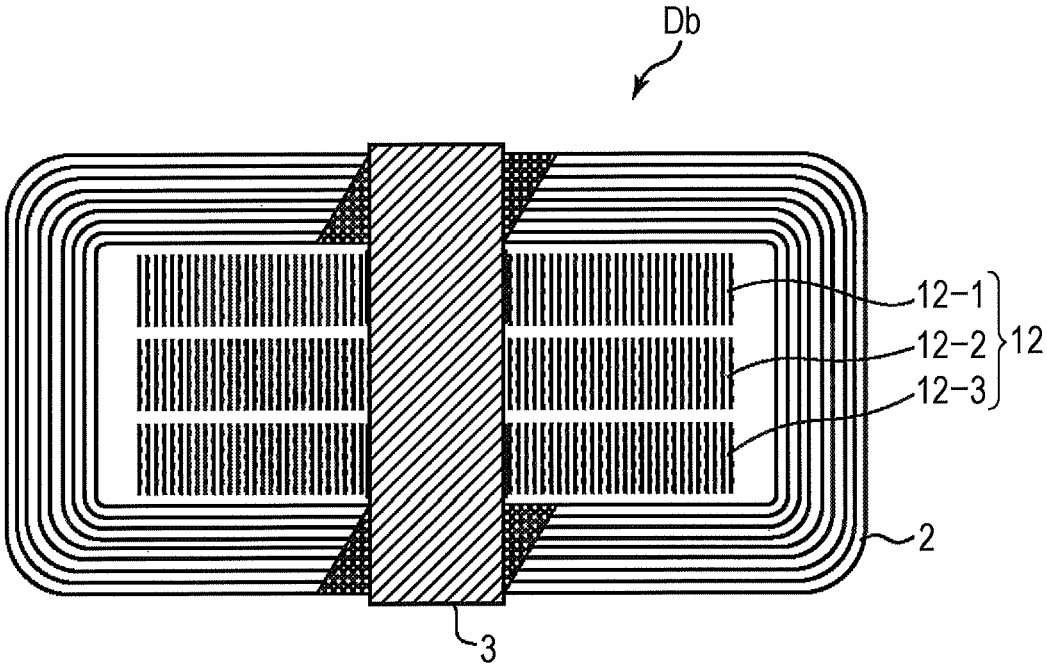
FIG. 9 is a sectional view illustrating the structure of a reactor according to a second embodiment.

FIG. 9 is a sectional view illustrating the structure of a reactor according to a second embodiment. While the coils 1 are layered substantially in the radial direction in the reactor Da of the first embodiment, a plurality of coils 12 are layered in the axial direction of the coils 12 as illustrated in FIG. 9, in a reactor Dd of the second embodiment. Because a core member 2 and a central core member 3 in the reactor Db of the second embodiment are similar to the core member 2 and the central core member 3 in the reactor Da of the first embodiment, description of both the members is omitted here.

The coils 12 in the reactor Db of the second embodiment are each constituted, for example, by winding a band-like conductor member to be layered with an insulating member interposed between windings of the conductor member such that the width direction of the conductor member is matched with the axial direction of the coil 12. Further, the coils 12 are constituted by stacking the plurality of wound band-like conductor members in the axial direction. In an example illustrated in FIG. 9, the plurality of coils 12 include three coils 12-1, 12-2 and 12-3. The coils 12-1, 12-2 and 12-3 are each constituted by winding a band-like conductor member to be layered with an insulating member interposed between windings of the conductor member such that the width direction of the conductor member is matched with the axial direction of the relevant coil 12. Further, the coils 12-1, 12-2 and 12-3 are stacked in the axial direction.

The thus-constructed reactor Db of the second embodiment can also provide similar advantageous effects to those obtained with the reactor Da of the first embodiment.

In the reactor D (Da, Db) of each of the first and second embodiments, the diameter of the wire WL of the core member 2 is preferably ⅓ or less of a skin thickness with respect to the frequency of the AC power supplied to the reactor D. In the reactor D thus constructed, since the diameter of the wire WL is ⅓ or less of the skin thickness with respect to the frequency of the AC power, an eddy current loss can be reduced. Additionally, given that the angular frequency of the AC power is $\omega$, the magnetic permeability of the wire is $\mu$, and the electrical conductivity of the wire is $\rho$, a skin thickness $\delta$ is generally expressed by $\delta=(2/\omega\mu\rho)^{1/2}$.

Further, in the reactor D of each of the first and second embodiments, when the 3-phase commercial power is supplied to the reactor D, the wire WL of the core member 2 preferably has a predetermined diameter corresponding to the commercial AC frequency of 50 Hz or 60 Hz. By setting the diameter of the wire WL of the core member 2 to the predetermined diameter corresponding to the commercial AC frequency, the reactor D can be provided to be more suitably adapted for the 3-phase commercial AC.

In the reactor D of each of the first and second embodiments, the central core member 3 may be a hollow cylindrical core member having a wall thickness not smaller than the skin thickness with respect to the frequency of the AC power supplied to the reactor Tr. The hollow cylindrical core member enables the reactor D to be cooled by causing a medium for cooling, e.g., air or oil, to flow through a hollow portion of the hollow cylindrical core member.

In the reactor D of each of the first and second embodiments, the central core member 3 may be a plurality of split core members, i.e., a plurality of pieces split in the circumferential direction thereof. Such an arrangement can also provide the reactor D of the embodiment.

In the reactor D of each of the first and second embodiments, the wire WL of the core member 2 may be one or may be divided into a plurality of wires. When the core member 2 is formed using the plurality of wires WL, the core member 2 can be formed by a first method of winding one wire WL (WL1) as described above, replacing the one wire WL (WL1) with the other wire WL (WL2) midway the winding, and winding the other wire WL (WL2) as described above, or by a second method of winding a plurality of wires WL (WL3) as described above. In the second method, the plurality of wires WL3 can be used in the form where the wires are arrayed parallel to each other and are encapsulated with resin or loosely twisted.

In the reactor D of the embodiment, the wire WL of the core member 2 is arranged such that the lengthwise direction of the wire WL is almost matched with the direction of the magnetic flux generated when the AC power is supplied to the coils 1. When the lengthwise direction of the wire WL is not completely matched with the direction of the magnetic flux, an induced electromotive force is generated in the wire WL with the magnetic flux. However, the core member 2 formed using the plurality of wires WL, as described above, can make comparatively small the potential difference between the ends of the wires WL, the potential difference being caused due to the induced electromotive force generated in the wires WL.

While this specification discloses techniques in the above-described various forms, primary ones of those techniques are as follows.

The reactor according to one form comprises a plurality of coils, and a core member serving as a path for magnetic flux that is generated when electric power is supplied to the coils, wherein the coils are constituted by respectively winding band-like conductor members to be layered with an insulating member interposed between windings of the conductor members such that a width direction of the conductor members is matched with an axial direction of the coils, and the core member is formed of a wire made of a magnetic material and is arranged outside the coils. In the reactor thus constructed, preferably, the coils are surrounded by the core member.

With the structure described above, since the core member is formed of the wire and is arranged outside the plurality of coils, the core member can be formed by the winding the wire, whereby the reactor can be more easily manufactured. As a result, it is possible to obtain higher productivity and to reduce the cost.

According to another form, in the above-described reactor, the wire of the core member is arranged such that a lengthwise direction of the wire is substantially matched with a direction of the magnetic flux generated when AC power is supplied to the coils.

Magnetic resistance of the wire of the core member increases at a larger number of times the wire traverses the magnetic flux produced by the coils to which the AC power is supplied. In view of that point, the wire of the core member is preferably positioned such that the lengthwise direction of the wire is matched with the direction of the magnetic flux as close as possible. With that arrangement, since the wire of the core member is arranged such that the lengthwise direction of the wire is almost matched with the direction of the magnetic flux, the wire of the core member traverses the magnetic flux at a smaller number of times, whereby the magnetic resistance is reduced. The above expression "almost matched with" implies that the lengthwise direction of the wire of the core member is substantially matched with the direction of the magnetic flux, i.e., that an angle θ formed by the lengthwise direction of the wire of the core member and the direction of the magnetic flux satisfies $-10° \leq \theta \leq +10°$. The angle θ satisfies preferably $-7° \leq \theta \leq +7°$ and more preferably $-5° \leq \theta \leq +5°$.

According to still another form, the above-described reactors further comprise a central core member made of a magnetic material, the central core member being arranged within a minimum inner diameter of the coils and being magnetically coupled to the core member.

With the structure described above, since the reactor includes the central core member, higher productivity can be obtained by using the central core member as not only a winding core for the coils, but also as a winding core for the core member.

According to still another form, in the above-described reactors, the coils are constituted by winding a plurality of band-like conductor members, which are layered with an insulating member interposed between the conductor members, such that a width direction of the conductor members is matched with an axial direction of the coils.

With the structure described above, since the coils can be manufactured in one winding step, manufacturing of the reactor of that type is facilitated.

According to still another form, in the above-described reactor, the coils are layered in a radial direction of the coils.

With the structure described above, since the coils are layered in the radial direction, the reactor having a reduced height (thickness) can be provided.

According to still another form, in the above-described reactors, the coils are stacked in the axial direction of the coils.

With the structure described above, since the coils are stacked in the axial direction, the reactor having a smaller diameter can be provided.

According to still another form, in the above-described reactors, a diameter of the wire of the core member is ⅓ or less of a skin thickness with respect to a frequency of AC power supplied to the reactor.

With the structure described above, since the diameter of the wire is ⅓ or less of the skin thickness with respect to the frequency of AC power, an eddy current loss can be reduced in the reactor having that structure. Additionally, given that the angular frequency of the AC power is ω, the magnetic permeability of the wire is μ, and the electrical conductivity of the wire is ρ, a skin thickness δ is generally expressed by $\delta=(2/\omega\mu\rho)^{1/2}$.

According to still another form, in the above-described reactor, the coils are three in number to be adapted for 3-phase commercial AC. Further, in the reactor thus constructed, the wire of the core member preferably has a predetermined diameter corresponding to the commercial AC frequency of 50 Hz or 60 Hz.

With the structure described above, the reactor for 3-phase commercial AC is provided. Further, since the diameter of the wire of the core member is set to the predetermined diameter corresponding to the commercial AC frequency, the reactor D can be provided to be more suitably adapted for the 3-phase commercial AC.

This application is on the basis of Japanese Patent Application No. 2010-113854 filed May 18, 2010, which is incorporated by reference herein in its entirety.

While the present invention has been adequately and sufficiently described above in connection with embodiments by referring to the drawings for the purpose of expressing the present invention, it is to be recognized that the foregoing embodiments can be easily modified and/or improved by those skilled in the art. Accordingly, it is to be construed that modified forms or improved forms carried out by those skilled in the art are involved within the scope of patent right defined in claims insofar as those forms do not depart from the scope of patent right defined in the claims.

INDUSTRIAL APPLICABILITY

According to the present invention, a reactor can be provided.

The invention claimed is:

1. A reactor comprising:

a central core member made of a magnetic material, extending in an axial direction;

a plurality of coils arranged around the central core member; and a core member serving as a path for magnetic flux that is generated when electric power is supplied to the coils, wherein the coils are constituted by respectively winding band-like conductor members to be layered with an insulating member interposed between windings of the conductor members such that a width direction of the conductor members is matched with said axial direction of the central core, and the core member is formed of a wire made of a magnetic material and is arranged outside the coils such that the coils are enclosed in a space formed by inner surface of the core member and the outer surface of the central core member and the wire of the core member is wound into a shape of a ball of string or yarn while surrounding the coils, wherein the wire of the core member is arranged such that a lengthwise direction of the wire is substantially matched with a direction of the magnetic flux generated when AC power is supplied to the coils, and each of said band-like conductor members has a width in the axial direction of the central core which is substantially the same as a dimension between the opposite ends of inside of the core member along the axial direction of the central core.

2. The reactor according to claim 1, wherein the coils are constituted by winding a plurality of band-like conductor members, which are layered with an insulating member interposed between the conductor members, such that a width direction of the conductor members is matched with an axial direction of the coils.

3. The reactor according to claim 2, wherein the coils are layered in a radial direction of the coils.

4. The reactor according to claim 1, wherein the coils are stacked in the axial direction of the coils.

5. The reactor according claim 1, wherein a diameter of the wire of the core member is ⅓ or less of a skin thickness with respect to a frequency of AC power supplied to the reactor.

6. The reactor according claim 1, wherein the coils are three in number to be adapted for 3-phase commercial AC.

7. The reactor according claim 1, wherein the width of the band-like conductor member in the axial direction of the central core member substantially equals to the axial dimension of the space formed by the inner surface of the core member and the outer surface of the central core member.

8. The reactor according claim 1, wherein the central core member includes a solid columnar member and flange members formed at opposite ends of the columnar member, each of flange members is formed in a predetermined thickness and has a depression formed in an outermost peripheral surface of the flange member wherein the core member is wound while engaged in the depression of the flange members.

9. The reactor according claim 1, wherein the central core member includes a solid columnar member and at least one disk-like member which is provided at each of opposite end surfaces of the columnar member which has a smaller radius than the columnar member wherein the wire of the core member is wound while engaged with the disk-like member.

10. The reactor according claim 1, wherein the central core member includes a solid columnar member and at least one disk-like member which is provided at each of opposite end surfaces of the columnar member which has a larger radius than the columnar member wherein the wire of the core member is wound while engaged with the disk-like member.

11. The reactor according claim 1, wherein the central core member includes a solid columnar member having such a length that the opposite end surfaces of the central core member are positioned within the core member.

12. The reactor according claim 11, wherein the length of the central core member is substantially equal to the length of coils in the width direction thereof.

13. The reactor according to claim 1, wherein the direction of the magnetic flux generated by the coils in a region extending in the axial direction of the central core is substantially in the axial direction and the direction of the magnetic flux generated by the coils in a region extending in the radial direction is substantially in the radial direction.

14. A reactor comprising:

a central core member made of a magnetic material, extending in an axial direction;

a plurality of coils arranged around the central core member; and a core member serving as a path for magnetic flux that is generated when electric power is supplied to the coils, wherein the coils are constituted by respectively winding band-like conductor members to be layered with an insulating member interposed between windings of the conductor members such that a width direction of the conductor members is matched with said axial direction of the central core, and when an AC power is supplied to the coils, a magnetic flux B of a magnetic field formed by the coils generates in the axial direction of the coils in a region of the coils extending in the axial direction and in a radial direction of the coils in a region of the coils extending in the radial direction;

the core member is formed of a wire made of a magnetic material and is arranged outside the coils such that the coils are enclosed in a closed space formed by inner surface of the core member and the outer surface of the central core member, and wherein the wire of the core member is arranged such that a lengthwise direction of the wire is substantially matched with a direction of the magnetic flux generated when the AC power is supplied to the coils, and each of said band-like conductor members has a width in the axial direction of the central core which is substantially the same as a dimension between the opposite ends of inside of the core member along the axial direction of the central core.

15. The reactor according to claim 1, wherein an angle θ formed by the lengthwise direction of the wire of the core member 2 and the direction of the magnetic flux satisfies $-10° \leq \theta \leq +10°$.

16. The reactor according to claim 14, wherein an angle θ formed by the lengthwise direction of the wire of the core member 2 and the direction of the magnetic flux satisfies $-10° \leq \theta \leq +10°$.

* * * * *